US005206681A

United States Patent [19]

Otomo et al.

[11] Patent Number: 5,206,681

[45] Date of Patent: Apr. 27, 1993

[54] ARRANGEMENT FOR FACILITATING OPENING AND CLOSING A CLAMSHELL TYPE OF COPYING MACHINE

[75] Inventors: Naoki Otomo; Toshio Shida, both of Hachioji, Japan

[73] Assignee: Konica Corporation, Tokyo, Japan

[21] Appl. No.: 760,874

[22] Filed: Sep. 16, 1991

[30] Foreign Application Priority Data

Sep. 16, 1990 [JP] Japan ..... 2-248498
Feb. 2, 1991 [JP] Japan ..... 3-33530

[51] Int. Cl.[5] ..... G03G 15/00
[52] U.S. Cl. ..... 355/200; 355/210
[58] Field of Search ..... 355/200, 210, 202, 260, 355/245

[56] References Cited

U.S. PATENT DOCUMENTS 4,619,519 10/1986 Takahashi et al. ..... 355/44 X
4,666,284 5/1987 Yamada ..... 355/44 X
4,748,481 5/1988 Kunihiro ..... 355/200 X
4,814,817 3/1989 Nishijima et al. ..... 355/200 X
4,876,572 10/1989 Nagatsuna ..... 355/210
4,952,974 8/1990 Mori ..... 355/200
4,965,640 10/1990 Watarai et al. ..... 355/283
5,045,885 9/1991 Nishio ..... 355/245
5,049,945 9/1991 Fukano et al. ..... 355/290

*Primary Examiner*—A. T. Grimley
*Assistant Examiner*—T. A. Dang
*Attorney, Agent, or Firm*—Frishauf, Holtz, Goodman & Woodward

[57] ABSTRACT

A clamshell-type copying machine for reproducing an image of a document. The copy machine has a body flame consisting of an upper half body, a lower half body, and a hinge-like connector of these half bodies. There are provided a first urging member, located in a vicinity of the opening, and a second urging member, located in a vicinity of the connector. Both of these urging member urge the upper half body and the lower half body to be separated from each other in which an urging force of the second urging member is greater than that of the first urging member.

8 Claims, 8 Drawing Sheets

ARRANGEMENT FOR FACILITATING OPENING AND CLOSING A CLAMSHELL TYPE OF COPYING MACHINE

BACKGROUND OF THE INVENTION

The present invention relates to an improvement of a copying machine, especially of a copying machine of a clamshell type.

In general, a copying machine of this type is composed of a clamshell structure wherein a main frame thereof can be opened with a conveyance path for a recording sheet as a boundary line, so that jam (clogging with paper) clearance may be carried out easily. To be concrete, the opening side of the main frame is arranged to be urged by an urging means such as a gas spring or the like so that it may be opened or closed around a supporting shaft provided on the sheet feeding side.

Not only the copying machine of the type mentioned above but also the latest copying machine are provided respectively with an ADF (automatic document feeder) unit that serves also as a document holder. When making copies from a book or a magazine, the ADF unit is opened and a document is placed on a platen glass, while when making copies from a sheet document, the ADF unit is closed for automatic feeding of documents.

However, when an ADF unit which serves also as a document holder is provided on the top of the main frame of the aforementioned conventional copying machine capable of being opened in a clamshell type, load imbalance is caused because of the supporting shaft side for opening and closing which is heavy, resulting in a fear that troubles such as fluttering opening and closing of a clamshell mechanism on the main frame might happen, which has been a problem.

Namely, in a conventional ADF unit, a supporting shaft for its opening and closing is located at its rear side for its easy opening and closing. However, a heavy portion such as a driving mechanism is provided in the vicinity of the supporting shaft for opening and closing. Therefore, on the opening and closing side of a copying machine on which an ADF unit is mounted, the rear portion is heavier than the front portion, resulting in a fear that a strain or a deformation is caused on the clamshell mechanism of the main frame and the opening and closing actions become unstable.

In view of the aforementioned point, the first object of the invention is to provide a copying machine equipped with a means capable of solving the load imbalance caused when an ADF unit is mounted on the copying machine.

Further, in a copying machine of this separated type wherein the copying machine is divided vertically into an upper half and a lower half, there is provided, between the upper half and the lower half, an elastic supporting member for supporting the upper half. When the elastic force of the supporting member is too small, the upper half can not be supported, while when it is too large, greater force is needed when the upper half is closed manually.

Incidentally, it is a recent trend that many functions are added to a copying machine, and it is considered that a copying machine of a separated type is equipped, as needed, with a mechanism called an automatic document feeder (ADF) capable of feeding automatically a document onto a document stand instead, for example, of feeding manually a plurality of documents one sheet by one sheet onto a document stand. In this case, due to tolerable weight of the ADF, total weight of the separated upper half equipped with the ADF is considerable. Therefore, the supporting force suitable for supporting the upper half without ADF is not sufficient for supporting the upper half with ADF. When designing from the beginning to give the supporting force sufficient for supporting the upper half with ADF, the supporting force is too great to pull down easily the upper half manually.

As a method for solving this problem, there are disclosed methods in Japanese Patent O.P.I. Publication Nos. 42769/1985 and 51349/1987 wherein a counter balance is provided for supporting the upper half and the supporting point for the counter balance is changed depending on the weight of the upper half, or the similar balancer spring is provided and its hooking position is changed to change the supporting force. Unlike the foregoing, it has been further suggested to change a gas spring to a stronger one.

However, the method to change the supporting position or the hooking position for the balancer spring when mounting or dismounting an ADF requires strong force for holding the balancer spring. Further, in the method wherein a balancer spring is replaced with the stronger one when mounting an ADF, one operator must replace a balancer spring while holding it with strong force when the other operator is keeping the upper half in an opened state, which means a tough and time-consuming work.

The present invention has been devised in view of the aforementioned point, and its second object is to provide a copying machine of a separated type wherein a work for coping with the change in weight of an upper half caused by mounting or dismounting of an optional device such as an ADF is easy.

SUMMARY OF THE INVENTION

The aforementioned first object of the invention is attained by a copying machine comprising urging means provided respectively at the side of an operation panel and the rear side thereof with which the main frame of the copying machine can be opened in a clamshell manner at its side for sheet ejection and comprising a supporting shaft for opening and closing located at the rear side on the top of the copying machine around which an ADF unit that serves also as a document holder is engaged to be mounted on the top surface of the copying machine, wherein opening force of the aforementioned urging means located at the rear side is greater than that of the urging means at the operation panel side and thereby to balance ill-balanced load of the ADF unit by changing opening force for the upper half of the main frame.

The second object of the invention is attained by an elastic and flexible supporting unit which is provided in a detachable manner between an upper half of the main frame and a lower half thereof on a front side or a rear side of the main frame of the copying machine and functions to urge the upper half upward.

When a function-adding unit such as an ADF is mounted on an upper half of the main frame, if a holding unit is provided between the upper half and a lower half and in the vicinity of a rotatable supporting point for the upper half, the upper half can be held in an open position against the lower half due to the holding force of the elastic member and the holding force given by the holding unit.

DETAILED DESCRIPTION OF THE INVENTION

Figure 1:
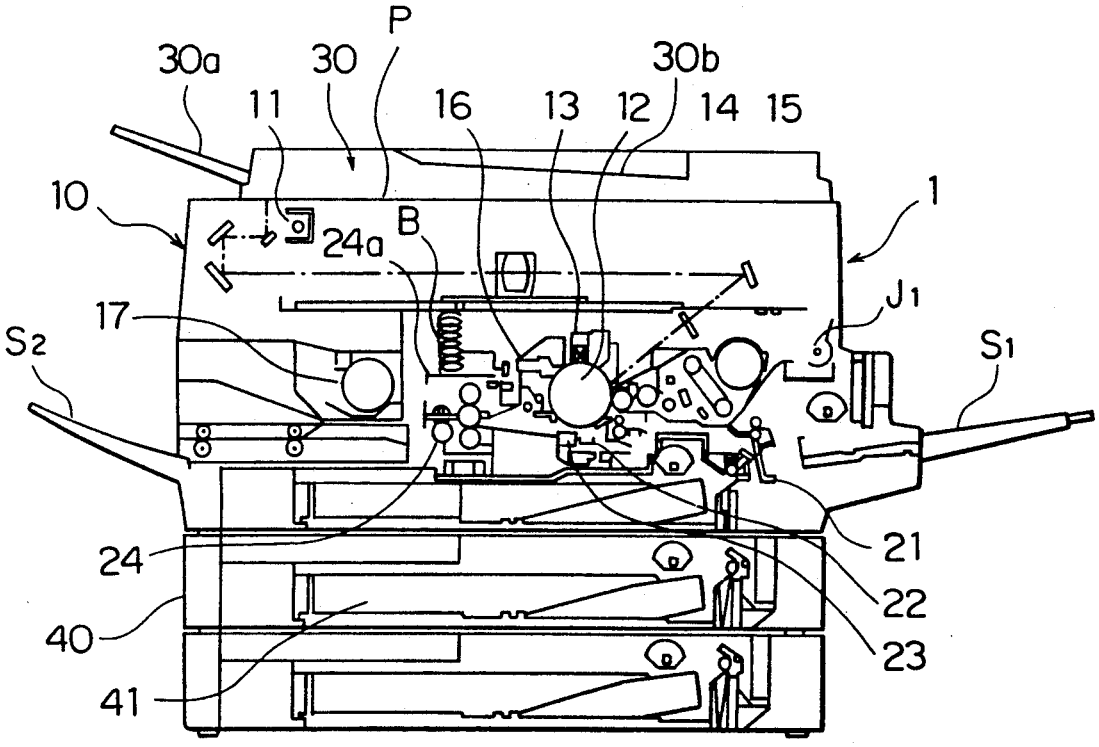
FIG. 1 is a front sectional view showing a general constitution of the first example.
Figure 2:
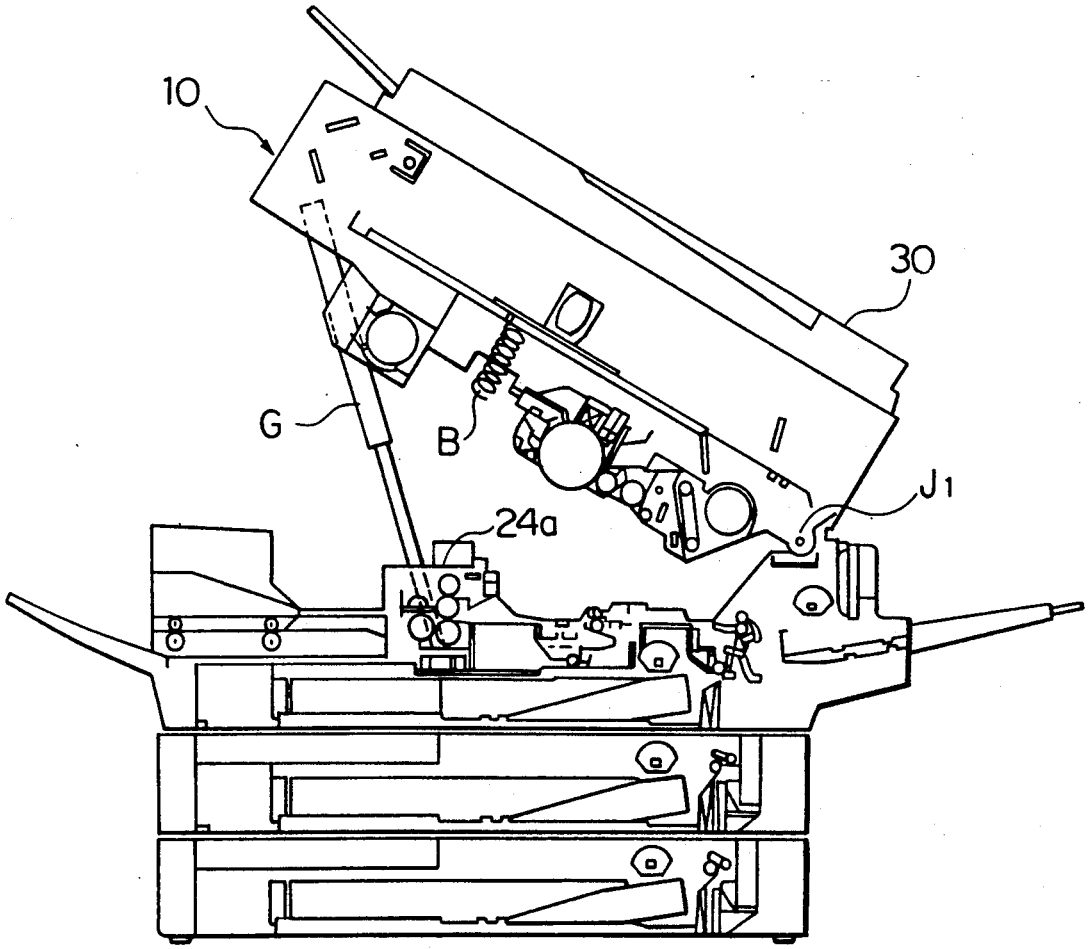
FIG. 2 is a front sectional view of the main frame with an opened upper half in accordance with a first embodiment.
Figure 3:
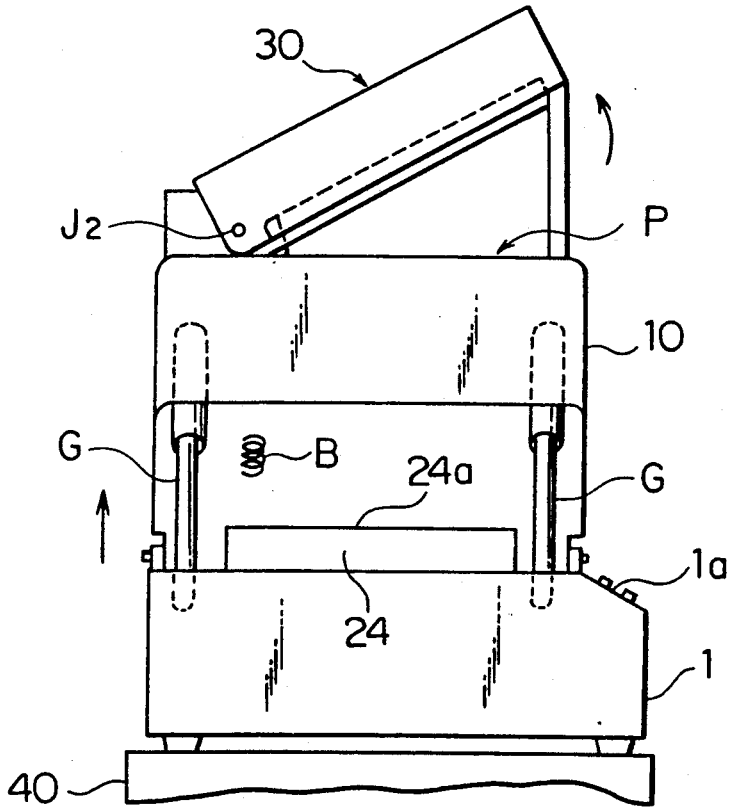
FIG. 3 is a side view wherein the opened state of the upper half of the main frame depicted in FIG. 2 is viewed from a sheet ejection side.

Referring to FIGS. 1-3, the first example achieving the first object of the invention will be explained as follows.

In the drawings, the numeral 1 is a main frame of a copying machine (hereinafter called a main frame) and the main frame 1 is constructed to be of a clamshell type. Namely, the main frame can be opened on its sheet ejection side as shown in FIG. 2 around supporting shaft J1 located at a sheet feeding side. The symbol G represents gas springs (urging means for opening) which support upper half 10 of the main frame. The gas springs G one of which is located at the front side and the other is located at the rear side urge the upper half 10 of the main frame upward so that it can be opened when a closing lock (not shown) is released.

The numeral 30 is an ADF unit mounted on platen glass P on main frame 1, and the ADF unit 30 automatically feeds in succession sheet documents stacked on sheet feeding tray 30*a* onto platen glass P, and then returns them onto document ejection tray 30*b*. With regard to documents which cannot be fed automatically, books e.g. and magazines, the ADF unit 30 itself can be opened at the front side around supporting shaft $J_2$, and it can be used as a document holder after a document is placed on platen glass P. The ADF unit 30 is provided with heavy components (not shown) such as a driving mechanism at its rear side where supporting shaft $J_2$ for opening and closing is located. Thus the rear side is heavier than the front side.

The symbol B is a spring for backing the urging force for opening of gas spring G at the rear side, and the spring B, when the upper half of the main frame is closed, hits an appropriate position (upper cover 24*a* of fixing unit 24 in the figure) in the main frame 1 and its reaction force caused by its urging force countervails a load corresponding to a difference in load between the rear side and the front side of the aforementioned ADF unit 30.

Incidentally, in order to obtain an action equivalent practically to the spring B, the gas spring G at the rear side is arranged naturally to be stronger in urging force than the gas spring G at the front side.

The numeral 40 is a cassette module, and 41 is a sheet feed cassette set in the cassette module 40. The recording sheet drawn out of the sheet feed cassette 41 can be conveyed toward the aforementioned photoreceptor drum 12 through sheet feeding unit 21 in the main frame 1. Sheet feeding can also be done from manual feed tray $S_1$.

The numeral 11 is an optical system provided at the upper portion of the upper half 10, and a document placed on platen glass P is irradiated by the optical system 11 and the resultant reflected light from the document is guided by the optical system 11 to be converted to an electrostatic latent image on the photoreceptor drum 12. The numeral 13 is a charging electrode, 14 is a developing unit, 15 is a toner supplying unit, 16 is a toner collecting unit, 17 is a cooling fan, 22 is a transfer electrode, 23 is a separating electrode, 24 is a fixing unit, and $S_2$ is a sheet ejection tray.

In the aforementioned example, when a document placed on platen glass P is irradiated by the optical system 11, the resultant reflected light causes formation of an electrostatic latent image on the photoreceptor drum 12. This electrostatic latent image is converted to a toner image by the developing unit 14 and then is transferred, by the transfer electrode 22, onto a recording sheet conveyed from the sheet feeding unit 21. Then, the recording sheet separated from the photoreceptor drum 12 by the separating electrode 23 is heated and pressed by the fixing unit 24 so that a toner image can be heat-fixed, and is transported for ejection toward an ejection outlet X.

In this case, sheet documents are fed onto platen glass P in succession by the ADF unit, while, for bound documents such as books and magazines, the ADF unit is opened for a while and is used to press the document against the platen glass for copying.

When opening the upper half 10 upward by releasing a lock for clearing the jammed recording sheet in the main frame 1, even when the rear side of the upper half is heavier due to the weight difference in the ADF unit, the gas spring G at the rear side, being backed by the spring B, is stronger in opening force than the gas spring G in the front side. Therefore, the upper half can be opened smoothly with its rear side and front side balanced by uniform force. The solution of load imbalance by means of the spring B is especially effective when the upper half having thereon an opened ADF unit is opened or closed.

In the first example, as stated above, the problem of ill-balanced load caused by the ADF unit mounted can be solved and reliability can be improved by a copying machine comprising urging means provided respectively at the side of an operation panel and the rear side thereof with which the main frame of the copying machine can be opened in a clamshell manner at its side for sheet ejection and comprising a supporting shaft for opening and closing located at the rear side on the top of the copying machine around which an ADF unit that serves also as a document holder is engaged to be mounted on the top surface of the copying machine, wherein opening force of the aforementioned urging means located at the rear side is greater than that of the urging means at the operation panel side.

The second example will be explained next, referring to FIGS. 4–9. The copying machine is divided into lower half 101 and upper half 102, and the lower half 101 is equipped with a sheet feeding unit, a transfer unit and a separation/fixing unit, while the upper half 102 is equipped with a photoreceptor drum, a developing unit and a developer replenishing unit. On one side (left side in the figure) of the lower half 101, there is provided a sheet-feeding stand 103 for manual feeding and on the other side (right side in the figure) thereof, there is provided sheet delivery tray 105 onto which a recording sheet finished to be recorded is ejected. The upper half 102 is so arranged as to be opened upward at its side where the sheet delivery tray 105 is provided, around pivot 104 provided on the sheet-feeding stand 103. In the figure, a solid line shows the opened upper half, while a dashed line shows the closed one.

Gas spring 106 is used for holding the upper half 102 in its opened state, and the lower end of the gas spring 106 is supported rotatably around pivot 107 located almost at the center of the lower half 101, while the upper end of the gas spring 106 is supported rotatably around pivot 108 (upper right side in the figure) provided on the upper half 102. The gas spring 106 is an elastic long member filled with gas therein and is constantly urged to extend. This urging force is designed to be balanced with the weight of the upper half 102, which holds the upper half 102 open. The opening angle of the upper half 102 is about 30 degrees, which allows an easy access for an operator in the case of jam clearance or the like.

When copying a number of documents, ADF 109 is mounted as an additional device at the location shown with a dashed line on the upper half 102. Concurrently with that, holding unit 110 is mounted in the vicinity of pivot 104 between the upper half 102 and the lower half 101. The holding unit 110 is an elastic member that is shorter than the gas spring 106, and when it is mounted, it extends due to its spring action, and is urged upward in the figure. The urging force of the holding unit 110 is designed to be balanced with the weight of ADF 9.

Figure 4:
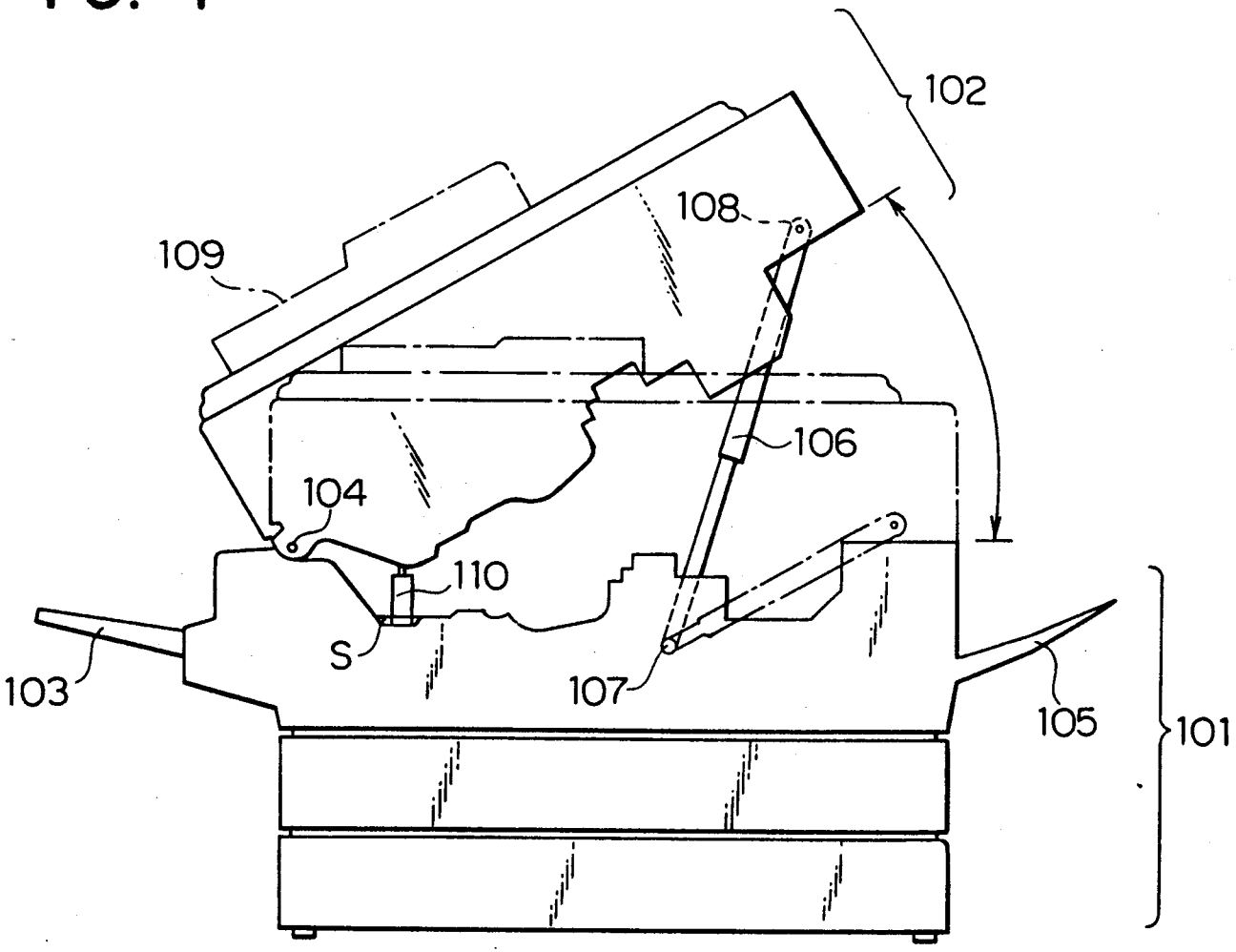
FIG. 4 is a rear view showing the opened state of a copying machine of a separated type in accordance with a second embodiment.

When the upper half 102 is pressed down manually, and then, it is closed the gas spring 106 contracts and moves to the position shown in FIG. 4 with a dashed line. In this case, the holding unit 110 also shrinks downward. Accordingly, the upper half 102 reaches the position indicated in FIG. 4 with a dashed line to be united with the lower half 101.

Therefore, it is possible, without replacing gas spring 106 or changing its fixing position, to open the upper half 102 upward or close it downward using the force that is identical to one used for opening or closing the upper half 102 on which the ADF 109 is not mounted.

The aforementioned operation will be explained in a more detailed manner as follows, referring to FIG. 5 and FIG. 6.

Figure 5:
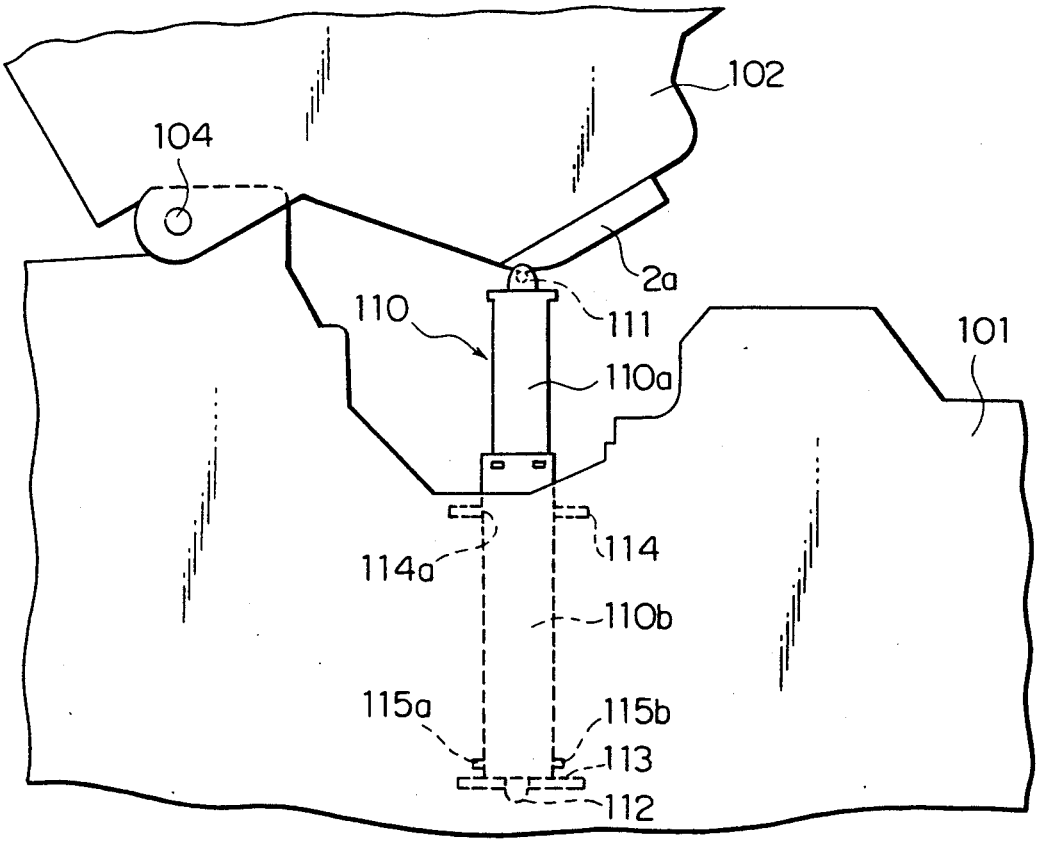
FIG. 5 is a fragmentary enlarged view of a portion near a pivot in the opened state of the copying machine depicted in FIG. 4.
Figure 6:
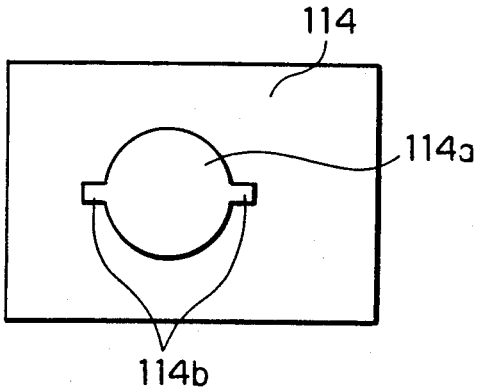
FIG. 6 is a top view of the supporting member shown in FIG. 5.

FIG. 5 is an enlarged view of the portion near pivot 104 under the condition that the upper half 102 is opened.

Under this state, roller 111 shown with a broken line provided at the tip of extended holding unit 110 and curved portion 102*a* formed on the upper half 102 are in contact with each other. The curved portion 102*a* is formed so that a tangent on the point where the curved portion 102*a* is in contact with the roller 111 of the holding unit 110 may constantly be horizontal. Therefore, the upper half 102 constantly applies its force to the holding unit 110 downward vertically when the upper half 102 is opened or closed, prevent the holding unit 110 from being bent by the abnormal force applied on the holding unit. On the bottom of the holding unit, there is formed protrusion 112 which is supported by being engaged with a hole formed on supporting member 113 of the lower half 101. In this case, the rotating shaft of the roller 111 is mounted so that it may be perpendicular to the plane of FIG. 5.

The central portion of the holding unit 110 is supported by supporting member 114 in a form of a flat plate provided on the lower half 101. The supporting member is positioned to be perpendicular to the plane of the figure and is provided with hole 114*a* shown in FIG. 6. The hole 114*a* is provided with two cut-outs 114*b* which allow both ends of spring pin 115 on the bottom of the holding unit 110 to pass through when the holding unit 110 is mounted or dismounted.

Figure 7:
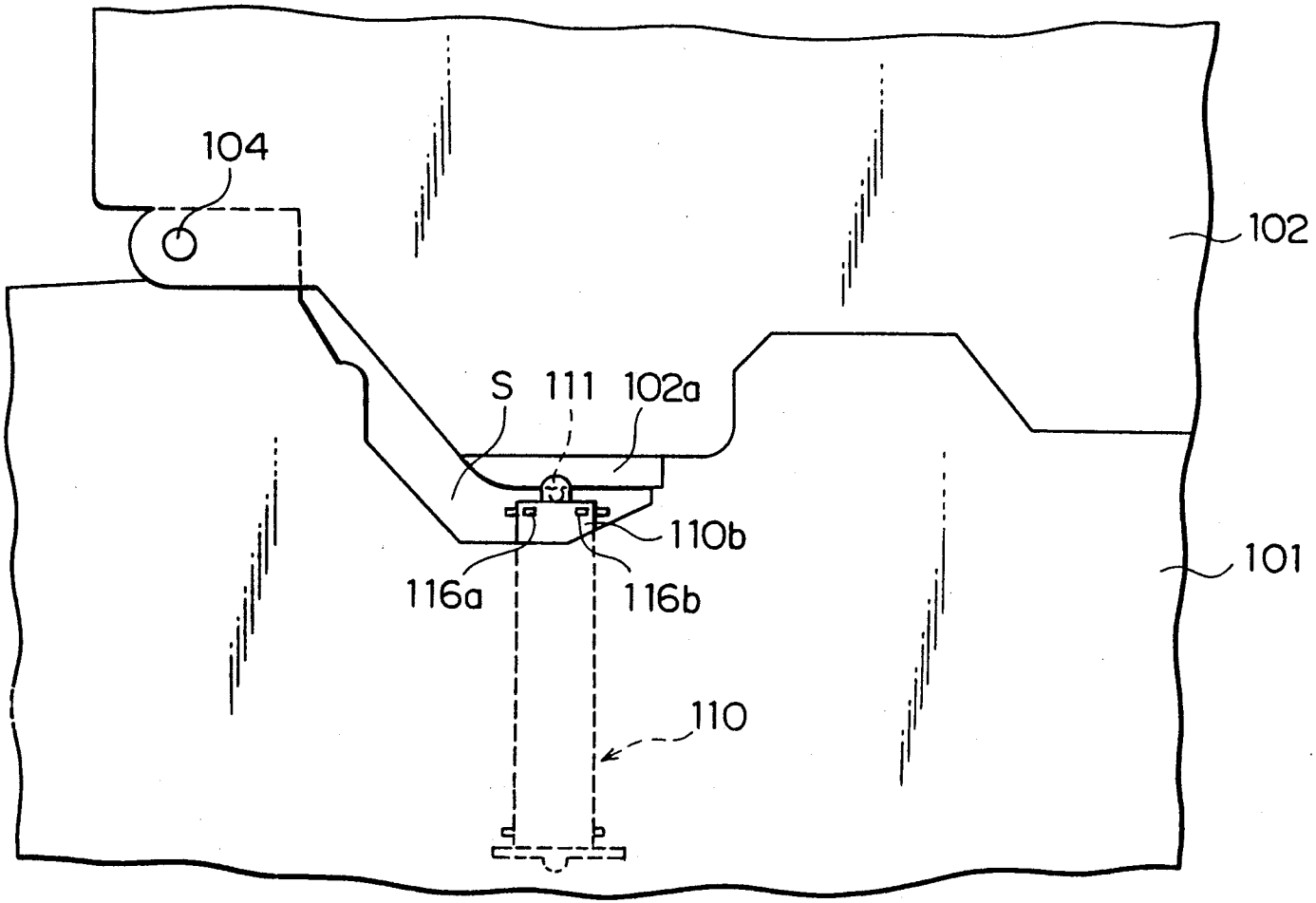
FIG. 7 is a fragmentary enlarged view of a portion near the pivot in the closed state of the copying machine depicted in FIG. 4.

FIG. 7 is an enlarged view showing the portion near pivot 104 when the upper half is closed.

Under this state, the holding unit 110 is in its contracted state with roller 111 being in contact with curved portion 102*a*. In the structure of the holding unit 110, cylinder 110*a* is housed in external cylinder 110*b* as shown in FIG. 5. On the lower half 101 of a copying machine, there is formed clearance S so that a head of cylinder 110*b* of the holding unit 110 may be exposed to the outside, especially that two holes 116*a* and 116*b* both formed on the upper portion of the cylinder 110*b* may be exposed to the outside.

Figure 8:
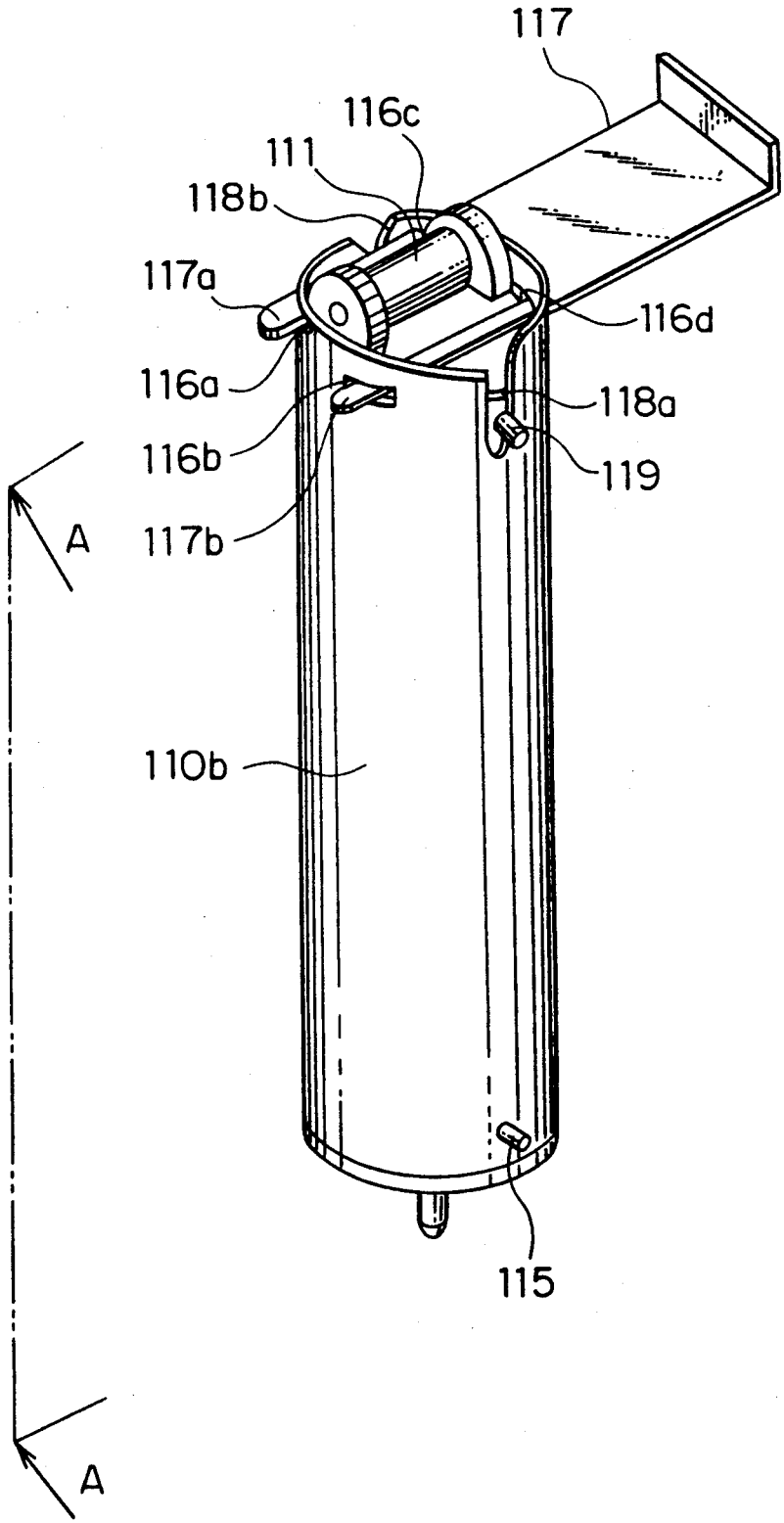
FIG. 8 is an external perspective view of a holding member of the second embodiment in its contracted condition.

FIG. 8 is an external perspective view showing the contracted holding unit 110.

The holding unit 110 is constructed so that cylinder 110*a* is housed in external cylinder 110*b*. On the upper portion of the cylinder 110*b*, there are formed holes 116*a* and 116*b*, and similar holes 116*c* and 116*d* are also formed on the opposite side. In these four holes 116*a*–116*d*, there are inserted two arms 117*a* and 117*b* of stopper 117. Between hole 116*b* and hole 116*d* both of cylinder 110*b*, there is formed groove 118*a* formed to be broadened upward by which the spring pin 119 at the upper portion is guided when the holding unit 110 is mounted. On the opposite side on the cylinder 110*b*, there is formed similar groove 118*b*. At the head of cylinder 110*a*, there is rotatably provided roller 111, and the rotating shaft of the roller 111 is in parallel with arms 117*a* and 117*b* of stopper 117. In this case the arms 117*a* and 117*b* of the stopper 117 are pushed up by the force of about 30 kg of a coil spring which will be described later. Therefore, they are not pulled out easily.

Figure 9:
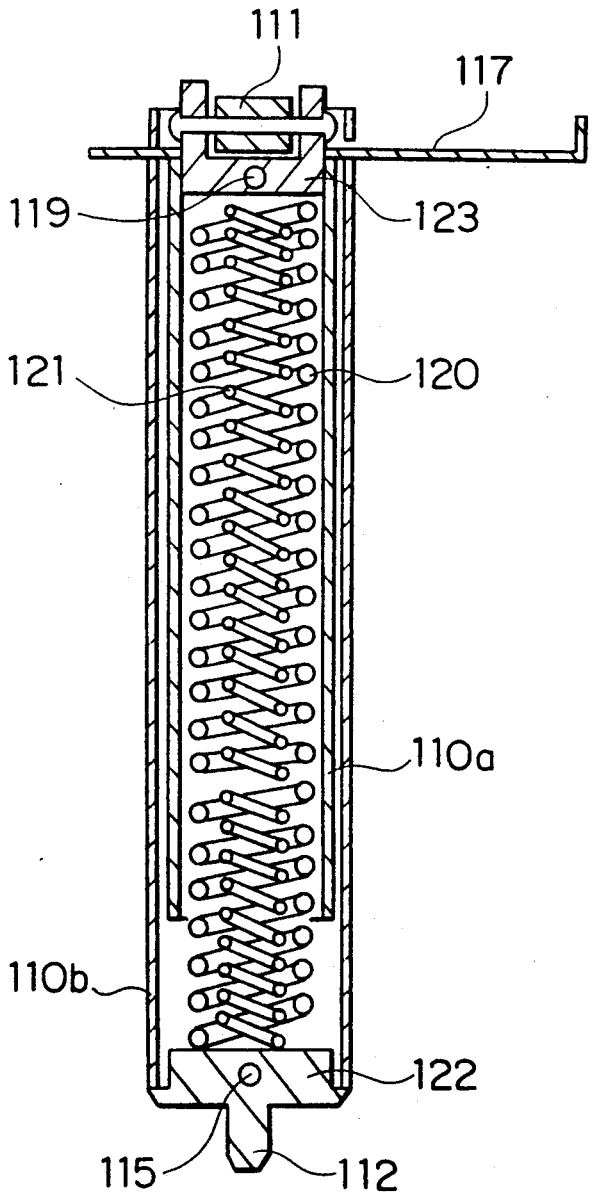
FIG. 9 is a sectional view of the holding unit 110 taken on line A—A in FIG. 8.

FIG. 9 is a sectional view taken on line A—A of holding unit 110 shown in FIG. 8.

As shown in the figure, two compressed coil springs 120 and 121 are provided, on a coaxial basis, in cylinder 110*a* that is housed in cylinder 110*b*. On the bottom of the cylinder 110*b*, fixed disk-shaped member 122 provided, at its center, with protrusion 112 being fixed by spring pin 115. On the head of cylinder 110*a*, disk-shaped member 123 that is united solidly with a supporter for a rotating shaft of roller 111 is fixed by spring pin 119. Cylinder 110*a* and cylinder 110*b* are held by stopper 117, thereby, springs 120 and 121 are held to be in a state of compression between disk-shaped member 122 and disk-shaped member 123.

When holding unit 110 having the structure mentioned above is mounted on a copying machine of a separation type, the upper half 102 is swung first so that the copying machine is in its opened state, and then the holding unit 110 is inserted in the hole 114*a* (FIG. 4) of member 114 (see FIGS. 5 and 6) provided in the vicinity of pivot 104. In this case, for example, it is also possible to provide, on the stopper 117 in advance, a bar type member (not shown) capable of passing through clearance S (FIG. 7) and to cause one end of the bar type member to be exposed to the outside for insertion from the front side. It is also possible to mount or dismount the stopper 117 from the rear side directly. Namely, the holding unit 110 can also be mounted or dismounted from the rear side. After that, the upper half 102 of the copying machine is closed. Accordingly, upper roller 111 of cylinder 110*a* of the holding unit 110 is pushed down by the curved portion 102*a* of the upper half 102. Therefore, the spring force of 30 kg applied on the stopper 117 is released. Now, the stopper 117 can be removed by drawing out the bar type member for the completion of mounting work.

Contrary to the foregoing, when removing the holding unit 110 from the copying machine, the upper half 102 is closed first, and arms 117*a* and 117*b* of the stopper 117 are inserted from the clearance S between the lower half 101 and the upper half 102 into holes 116*a*–116*d* formed on the upper portion of cylinder 110*b* of the holding unit 110, and then the upper half 102 is opened for removing the holding unit 110.

In the second example of the invention, when mounting an additional function unit such as ADF 109 or the like on the upper half 102 of a copying machine, only one operator can cope with an imbalance of the weight of the additional function unit easily by mounting the holding unit 110 in the vicinity of pivot 104 between the lower half 101 and the upper half 102 and by dismounting the stopper 117. This is done replacing gas spring 106 that is to be provided from the beginning or changing the fixing position for the gas spring 106. Further, compared with gas spring 106, the holding unit 110 is very compact, light and portable, allowing easy transport and control, which represent advantageous points of the holding unit.

Though the holding unit in the present example is of a cylindrical form, the invention is not limited to that, and a polygonal section of a holding unit may also be allowed.

As described above, in the second example of the invention, a holding unit can freely be mounted on or dismounted from the portion in the vicinity of the supporting point for rotation of the upper half between the upper half and the lower half, and when a function adding unit such as an ADF is mounted on the upper half, the holding unit is mounted, thereby the force for supporting the weight-increased upper half to be opened is strengthened, while the function adding unit is dismounted, the holding unit is removed so that the upper half can be opened or closed with an ordinary force, resulting in an easy work for coping with weight change in the upper half.

What is claimed is:

1. An image forming apparatus for reproducing an image of a document, comprising:

a lower half of said apparatus;

an upper half of said apparatus;

means for connecting said lower half and said upper half so that said upper half pivots relative to said lower half to open or close said apparatus around an axis;

a first urging means located at a first side which is perpendicular to said axis; and a second urging means located at a second side which is opposite to said first side;

wherein both of said first urging means and said second urging means cause at least one of said upper half and said lower half to move so as to be separated from each other, and an urging force of said second urging means is greater than an urging force of said first urging means.

2. The apparatus of claim 1, further comprising:

means for automatically feeding said document to a reading means of said apparatus;

wherein said document feeding means is mounted on said upper half of said apparatus.

3. The apparatus of claim 2, wherein said document feeding means includes a shaft with which it is pivotally mounted to the upper half of said apparatus, said shaft being located along said second side.

4. An image forming apparatus for reproducing an image of a document, comprising:

a lower half of said apparatus;

an upper half of said apparatus;

means for connecting said lower half and said upper half so that said upper half pivots relative to said lower half to open or close said apparatus around an axis;

a first urging means located at a first side which is perpendicular to said axis; and a second urging means located at said first side or a second side which is opposite to said first side, and in a vicinity of said axis;

wherein said first urging means and said second urging means cause at least one of said upper half and said lower half to move so as to be separated from each other

5. The apparatus of claim 4, wherein said second urging means comprises means for retaining said second urging means in its contracted state.

6. The apparatus of claim 4, further comprising:

means for automatically feeding said document to a reading means of said apparatus;

wherein said document feeding means is mounted on said upper half of said apparatus.

7. An image forming apparatus for reproducing an image of a document, comprising:

a lower half of said apparatus;

an upper half of said apparatus;

means for connecting said lower half and said upper half so that said upper half pivots relative to said lower half to open or close said apparatus around an axis;

a first urging means located at a first side which is perpendicular to said axis; and a second urging means located at a second side which is opposite to said first side;

wherein both of said first urging means and said second urging means urge said upper half and said lower half to be separated from each other, and an urging force of said second urging means is greater than an urging force of said first urging means, and wherein said first urging means is a gas spring and said second urging means comprises a gas spring and a spring.

8. An image forming apparatus for reproducing an image of a document, comprising:

a lower half of said apparatus;

an upper half of said apparatus;

means for connecting said lower half and said upper half so that said upper half pivots relative to said lower half to open or close said apparatus around an axis; p1 a first urging means located at a first side which is perpendicular to said axis; and a second urging means located at said first side or a second side which is opposite to said first side, and in a vicinity of said axis;

wherein said first urging means and said second urging means urge said upper half and said lower half to be separated from each other, and wherein said second urging means comprises:

an external cylinder;

an internal cylinder housed in said external cylinder;

slots for mounting said retaining means on said second urging means, said slots being provided on a top of said external cylinder;

a roller provided on a top of said internal cylinder;

two compressed coil springs coaxially housed in said internal cylinder; and a disk-shaped member mounted on a bottom of said internal cylinder;

wherein said upper half has a curved portion facing said roller so that said curved portion is capable of pushing down said roller so as to remove said stopper from, or mount said retaining means on, said second urging means.

* * * * *